US007793427B2

(12) United States Patent
Sessa et al.

(10) Patent No.: US 7,793,427 B2
(45) Date of Patent: Sep. 14, 2010

(54) PLATFORM FOOTWEAR CONSTRUCTION AND RELATED METHOD

(75) Inventors: Raymond V. Sessa, Grand Rapids, MI (US); Clement M. Caron, Sr., Rockford, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 914 days.

(21) Appl. No.: 11/565,963

(22) Filed: Dec. 1, 2006

(65) Prior Publication Data

US 2008/0127516 A1 Jun. 5, 2008

(51) Int. Cl.

| | |
|---|---|
| ***A43B 7/16*** | (2006.01) |
| ***A43B 15/00*** | (2006.01) |
| ***A43B 13/28*** | (2006.01) |
| ***A43B 9/04*** | (2006.01) |
| ***A43B 9/00*** | (2006.01) |

(52) U.S. Cl. ..... 36/17 R; 36/12; 36/92; 36/30 R

(58) Field of Classification Search ..... 36/92, 36/31, 12, 15, 17 R, 30 R
See application file for complete search history.

(56) References Cited

U.S. PATENT DOCUMENTS

| | | | | |
|---|---|---|---|---|
| 2,005,048 | A * | 6/1935 | Randall | 36/19.5 |
| 2,021,192 | A * | 11/1935 | Miller | 36/17 R |
| 4,446,633 | A * | 5/1984 | Scheinhaus et al. | 36/11.5 |
| 4,835,884 | A * | 6/1989 | Bianchini et al. | 36/24.5 |
| 5,077,915 | A * | 1/1992 | Gross | 36/31 |
| 5,465,507 | A * | 11/1995 | Schumacher et al. | 36/30 R |
| 5,765,295 | A * | 6/1998 | Srourian et al. | 36/24.5 |
| 6,564,476 | B1 * | 5/2003 | Hernandez | 36/28 |
| 6,948,263 | B2 * | 9/2005 | Covatch | 36/30 R |
| 7,010,867 | B2 | 3/2006 | Brown | |
| 7,076,889 | B2 | 7/2006 | Palmer et al. | |
| 7,096,602 | B2 | 8/2006 | Palmer et al. | |

FOREIGN PATENT DOCUMENTS

DE 4118311 A1 * 12/1992

* cited by examiner

*Primary Examiner*—Jila M Mohandesi
(74) *Attorney, Agent, or Firm*—Warner Norcross & Judd LLP

(57) ABSTRACT

A footwear construction including an upper secured to a platform defining an aperture, a cushion at least partially in the aperture, a California construction joined with the upper that wraps the platform, and an outsole. The California construction can terminate short of the heel, and the upper can join the platform via another construction, for example, by adhering the upper to the platform, in the heel. The cushion insert can define one or more recesses, such as concave contours in which the toe(s) of a wearer can rest to reduce the profile of the toe(s) above the cushion insert. A method for making the footwear is provided, including: joining an upper with a platform defining an aperture on a last; placing a cushioned insert within the aperture; wrapping a California flange around a portion of the platform; and joining an outsole with the platform, the cushioned insert and/or the upper.

18 Claims, 6 Drawing Sheets

PLATFORM FOOTWEAR CONSTRUCTION AND RELATED METHOD

BACKGROUND OF THE INVENTION

The present invention relates to footwear, and more particularly, to footwear including a platform construction.

In the footwear industry, there is an ongoing effort to produce footwear that is aesthetically pleasing, but that also provides exceptional support and comfort. This effort is increased in relation to casual, business casual and dress footwear. Wearers of these footwear require their footwear to be dressy enough to provide a professional or finished appearance; however, due to the long hours spent at work or entertaining in the footwear, these individuals also require that the footwear have sufficient cushioning, a comfortable fit, and good support.

One type of footwear construction that, to some extent, can satisfy the aesthetically pleasing requirement for business/casual/dress footwear is the California construction. This construction generally includes an upper to which a "California flange" is secured. Specifically, the upper of this construction includes a lower periphery to which a long, slender piece of material—a California flange—is stitched. The material is initially stitched so that the unfinished underside of the piece faces outward, and the finished aesthetic side faces inward, toward the remainder of the upper. This piece is then turned down so that the aesthetic side becomes visible, and the stitching is concealed. An outsole is then secured with stitching or cement to the unstitched portion of the piece. A cushion usually is placed over the cemented portion of the piece and the portion of the outsole facing the interior of the upper to provide a limited amount of cushioning.

Although conventional California constructions can provide a pleasing appearance, these constructions frequently fail to provide a desired level of support. For example, because the California construction uses the simple flange to join the upper and the outsole, the resulting footwear are very flexible—and indeed almost slipper-like. Accordingly, the foot of a wearer of the footwear is provided with flexibility, but is offered little support. Further, the cushion of conventional California constructions usually must be thin so as to leave a comfortable amount of space within the upper for the wearer's foot. This is usually the case where California constructions are incorporated into women's footwear, which are typically diminutive to minimize the apparent size of the wearer's foot; and this is almost always the case where such constructions are included in footwear including a thin toe box because a significant amount of space within the toe box is consumed by the profile of the wearer's toes projecting entirely above the cushion. Thus, many times, insufficient cushion is provided in footwear including California or similar aesthetic constructions. In addition, because of the slender nature of the cushion, conventional California constructions typically are unable to provide added height to the wearer, which may be desirable for wearers of diminutive stature.

Accordingly, there remains an unmet need for a visually pleasing, highly supportive, comfortable footwear including a California or similar aesthetic construction.

SUMMARY OF THE INVENTION

The aforementioned problems are overcome by the present invention which provides a footwear construction that provides an upper secured to a platform that defines a cushion aperture, a cushion insert projecting at least partially into the cushion aperture, a California construction joined with the upper that wraps the platform, and an outsole joined with at least one of the platform and the upper. In one embodiment, the California construction can be joined with the platform primarily in the forefoot of the footwear construction, and in the heel of the footwear construction, the upper can be joined with the platform via another construction, for example, by adhering the upper to the platform.

In another embodiment, the California construction terminates short of the heel of the footwear construction, and the upper is cemented to the platform in the heel of the footwear construction. Optionally, the California construction is located substantially only in the forefoot of the footwear. Further optionally, the cushion aperture and cushion are likewise located substantially only in the forefoot portion.

In another embodiment, a portion of the cushion insert extends into the cushion aperture, and a remaining portion overlays an upper surface of the platform surrounding the cushion aperture.

In yet another embodiment, the cushion insert defines a recess corresponding to the position of one or more toes of a wearer of the footwear so that the toe(s) rest at least partially within the recess. In turn, this reduces the profile of the toe(s) above the cushion insert.

In a further embodiment, a method for making the footwear is provided, including: joining a California flange with an upper; positioning the upper on a last; placing a platform defining an aperture on the last; placing a cushioned insert at least partially within the aperture; wrapping the California flange around at least a portion of the platform; and joining an outsole with at least one of the platform, the cushion insert and the upper. Optionally, the California flange is wrapped so that it terminates short of the heel of the footwear, and in the heel of the footwear, the upper is adhered to the platform.

The present invention provides an aesthetic footwear construction that has a platform style, exceptional cushioning and height, significant support, as well as a pleasing appearance. Specifically, the platform of the footwear provides exceptional support. The improved California construction provides both height and cushioning, a pleasing appearance, as well as a degree of flexibility in the footwear—particularly in the forefoot of the footwear when the California construction is provided primarily in that region. Further, where the platform construction is included in the heel region of the footwear, the appearance of the resulting footwear is rendered sleek and aesthetically pleasing. In addition, where included, the contoured cushion or platform provides a lower toe profile, which in turn provides increased space for cushioning and increased toe box volume within the footwear. As a result, this provides improved comfort.

These and other objects, advantages, and features of the invention will be readily understood and appreciated by reference to the detailed description of the present invention and the drawings.

DETAILED DESCRIPTION OF THE PRESENT INVENTION

I. Overview

Figure 1:
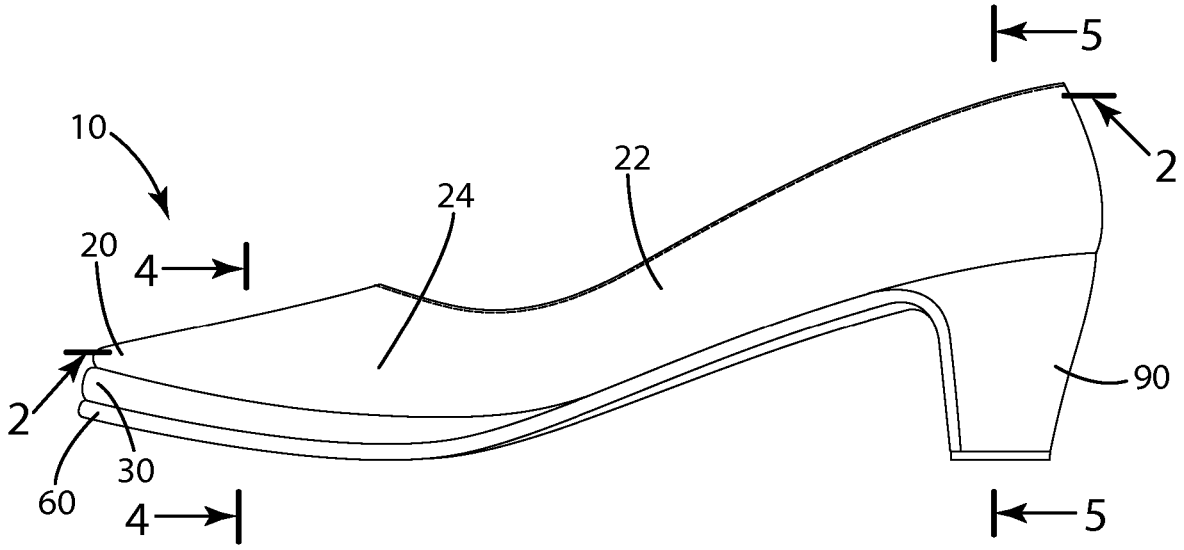
FIG. 1 is a side view of footwear of a current embodiment.
Figure 2:
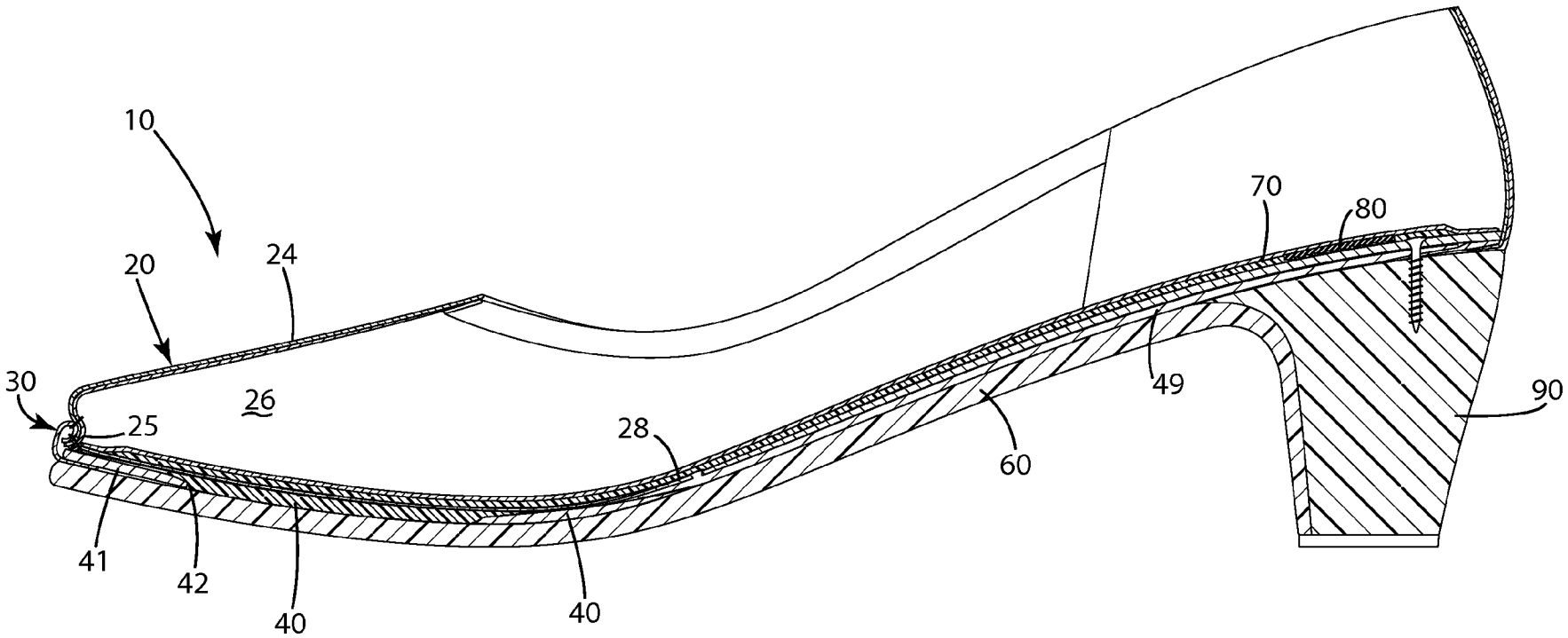
FIG. 2 is a sectional view of the footwear taken along line 2-2 of FIG. 1.
Figure 3:
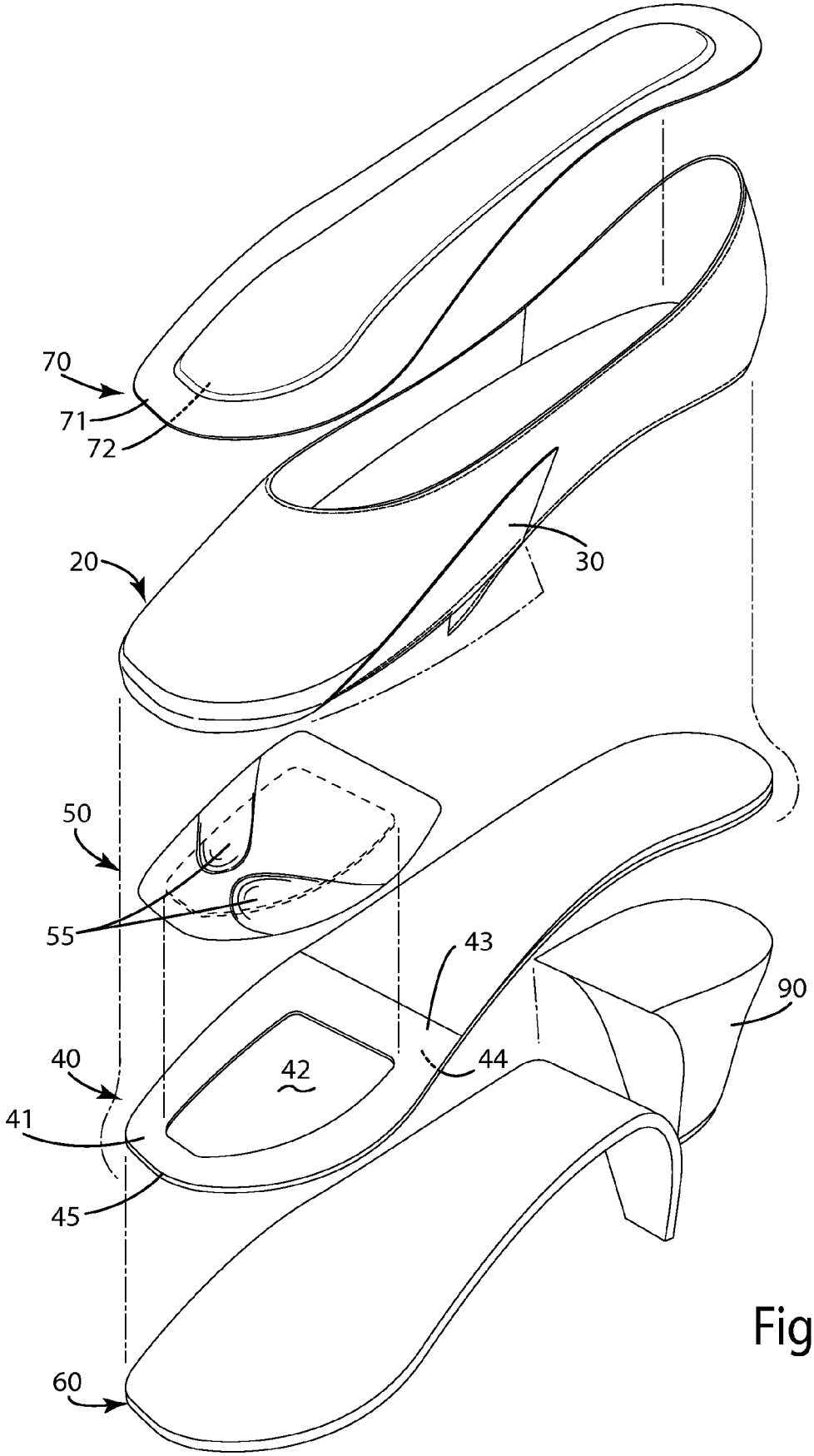
FIG. 3 is an exploded perspective view of the footwear.
Figure 4:
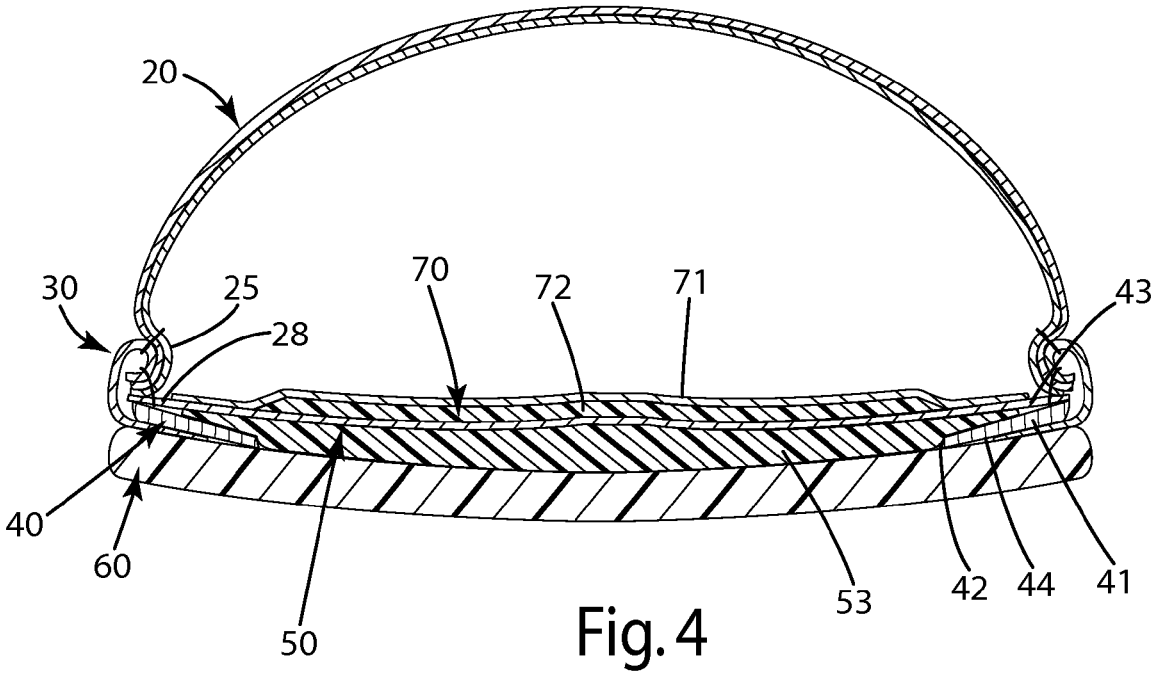
FIG. 4 is a sectional view taken along line 4-4 of FIG. 1.
Figure 5:
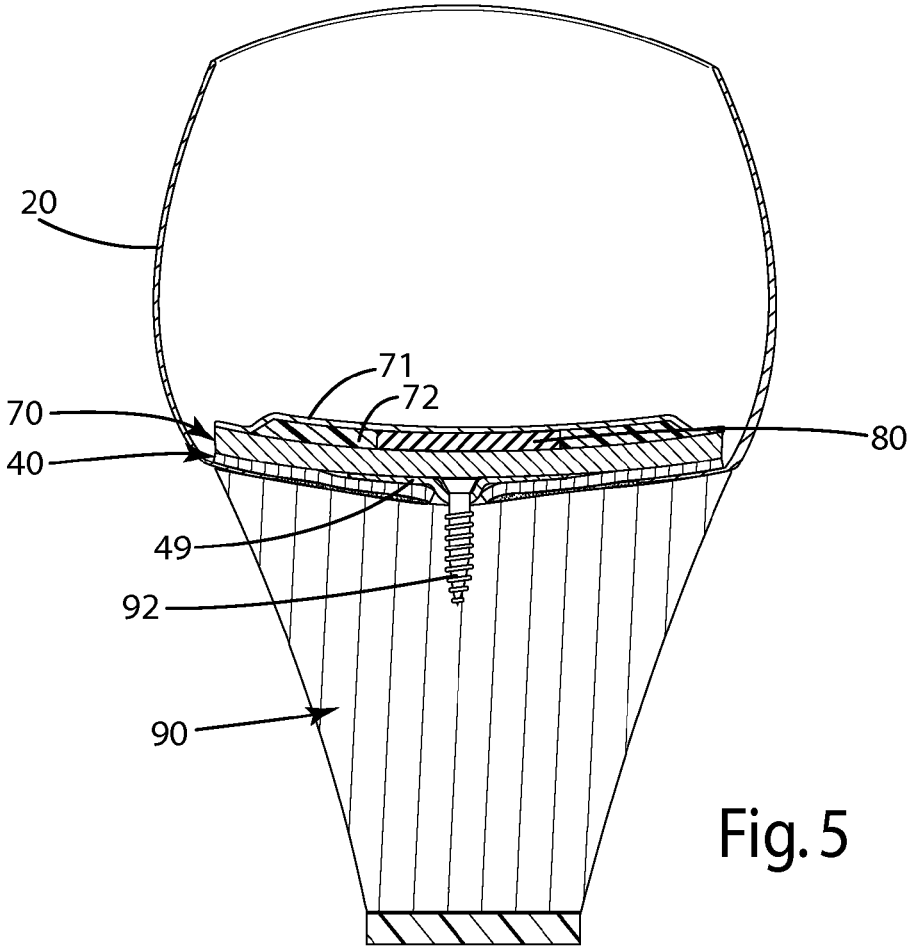
FIG. 5 is a sectional view taken along line 5-5 of FIG. 1.
Figure 8:
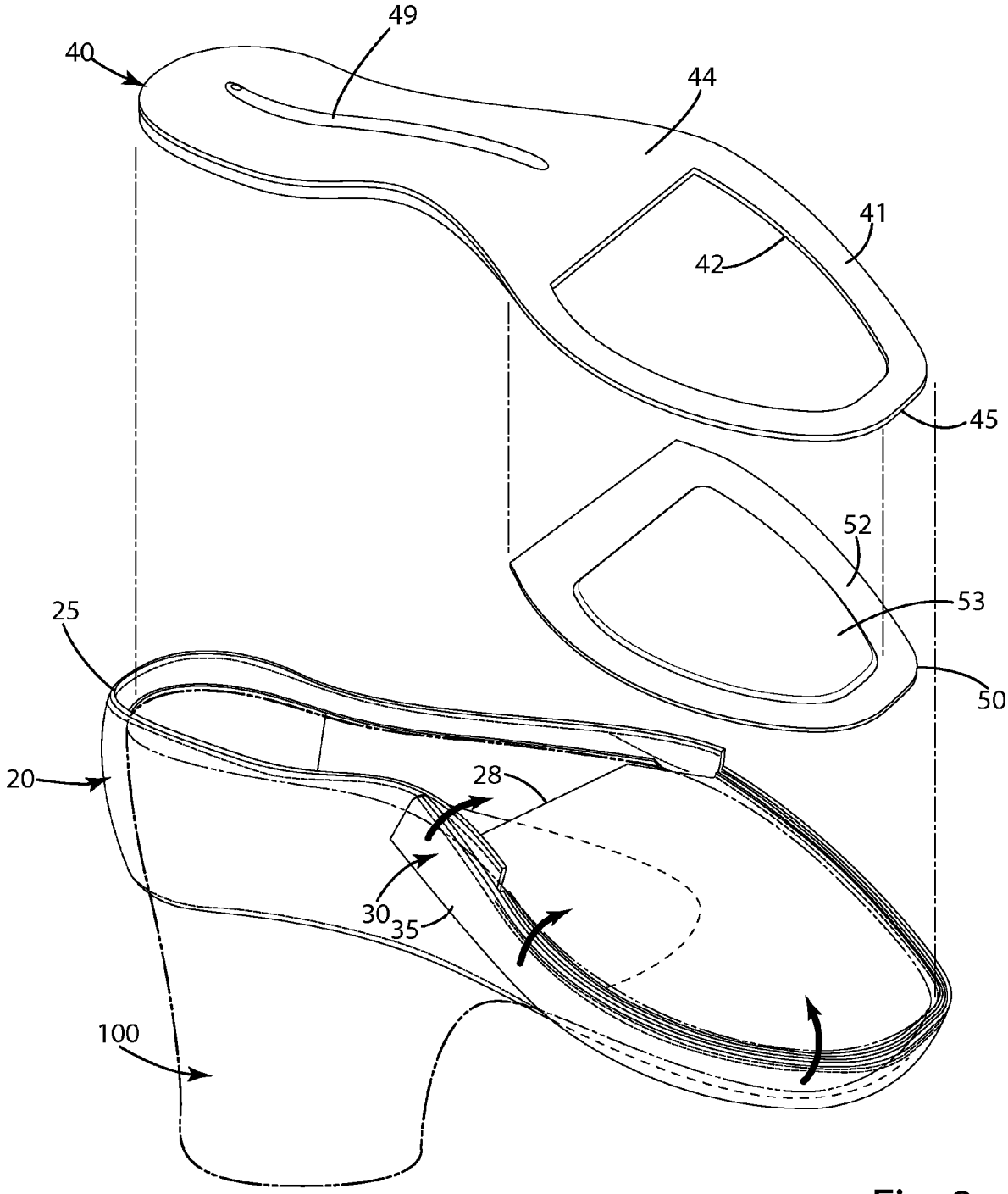
FIG. 8 is a perspective view of the footwear being assembled on a last.

Footwear constructed in accordance with a current embodiment is shown in FIGS. 1-6 and generally designated 10. The footwear 10 includes an upper 20 to which a California flange 30 is secured. The upper 20 is joined with a platform 40, which defines an aperture 42. A cushion insert 50 is positioned at least partially within the aperture 42. An outsole 60 can be joined with the platform 40 and/or upper 20. A footbed 70 can be inserted in the footwear, over the platform 40. As shown in FIGS. 3, 5 and 8, the California construction can terminate short of the heel of the footwear; and in the heel of the footwear, the upper 20 can be cemented to the platform 20.

For purposes of disclosure, the present invention will be described in connection with a casual women's shoe. As will be appreciated, the present invention is well suited for use with any other type of soled footwear, including business, business casual, dress, sandalized, walking, and work footwear, regardless of gender.

II. Structure

The components of the shoe 10 will now be described in more detail. The upper 20 generally is conventional and includes quarters 22 and a vamp 24, which can be separate or integral components. As shown in FIG. 3, the upper forms a toe box 26 in forward portion of the forefoot of the shoe. This toe box 26 generally corresponds to the area of the shoe where the toes of a wearer are positioned. The upper 20 terminates at a lower portion thereof in a peripheral allowance 25. To the peripheral allowance 25, a slender piece of material, shown as a California flange 30, is secured, for example, by stitching or other fastening methods. As shown, the California flange 30 is joined with the upper in the forefoot and a portion of the arch regions of the footwear. The California flange can extend into the remainder of the arch portion and/or the heel of the footwear as desired. Indeed, the California flange, and resulting California construction, optionally can be isolated in only the heel or other regions as desired.

The upper 20 also can include a bottom 28 secured thereto. As shown in FIG. 4, the bottom 28 can extend from one side of the upper to the other in substantially only the forefoot of the footwear. However, the bottom can be included in other regions of the footwear, for example, it can extend across the arch and heel regions as well to close off the entire interior of the upper as desired.

As shown in FIGS. 3, 5 and 8, the upper 20 can be secured to the platform via the California flange 30, which terminates short of the heel of the footwear. In the heel region, the upper 20 can be directly secured to the platform 40 by any suitable means, for example by adhering, cementing, stitching, stapling and the like. Of course, the upper 20 can also terminate short of the heel, for example, in open back footwear, in which case the platform 40 can be covered with a piece of trim as desired.

The upper and California flange can be constructed from any suitable material such as leather, neoprene, EVA, plastic, mesh fabric or canvas.

As shown in FIGS. 2-5, the shoe includes a platform 40. The platform 40 generally can extend from the forefoot of the footwear to the heel of the shoe. In the arch and heel, the platform 40 can include a support shank 49. This shank can be a bar or strip of material, such as metal, plastic or other synthetic or natural material that is at least somewhat rigid. Where the shoe is to include a heel post 90, the shank, if extended to the heel, can define a hole through which a fastener 92 can be sunk into the heel post 90 (FIG. 5).

The platform 40 also can include an upper side 43, an underside 44, and a periphery 45. The periphery can be configured to correspond to the shape of a wearer's foot, or more generally the interior of the upper 20. Further, the platform can be constructed from a rigid or semi-rigid material, such as fabric board, to provide support to the resulting footwear.

The platform 40 can define a cushion aperture 42. As shown in FIGS. 2-4, the aperture is located in the forefoot of the footwear, however, it can be located and/or extend to the arch and/or heel regions as well or alternatively. The aperture generally extends across the forefoot, optionally leaving a margin 41 of the platform to surround it in the forefoot.

A cushion insert 50 (FIGS. 4, 6 and 7) is at least partially positioned in the aperture 42. The insert 50 can be a single, relatively flat and planar cushion, or can include a base 52 and projecting portion 53. The insert 50, optionally the projecting portion 53, can extend completely through the aperture so that a portion extends beyond the underside 44. Alternatively, the insert 50 can terminate just short of, or flush with the underside 44.

As shown in FIGS. 4 and 5, the insert base 52 can be positioned immediately adjacent the upper side 43 of the platform. Optionally, the insert base can extend beyond the aperture 42 a distance, and as shown in FIG. 3 can overlap all or a portion of the margin 41.

Referring now to FIGS. 2 and 4, the cushion insert upper side 53 can define one or more recesses 55. These recesses 55 can be in the form of concave or other contours that correspond to the position of at least one toe of a wearer of the shoe 10 so that the at least one toe rests at least partially within the contour, thereby reducing the profile of the at least one toe above the cushion insert. In this manner, the toes rest partially "in" the insert rather than "on" it. In the current embodiment, one of the contours can correspond to the big toe of the wearer, and another contour can correspond to the remaining toes of the wearer. Any other combination of contours can be chosen as desired.

The cushion insert can be constructed from plastic, EVA, polyurethane, hard rubber or other suitable materials.

As illustrated in FIG. 5, the shoe 10 can further include an optional heel cushion 80. The heel cushion 80 can be positioned adjacent the platform, for example, on the upper side 43. In the current embodiment, the heel cushion 80 can be secured to the platform 40 in any manner, for example with an adhesive or by stitching.

The shoe 10 can further include a footbed 70 positioned adjacent the platform 40. This footbed can be constructed from a piece of material such as leather or a synthetic material. Optionally, the piece of material 71 can be backed with an optional secondary cushion 72.

With reference to FIGS. 2 and 3, the outsole 60 is constructed from a relatively hard, but gripping rubber or other sufficiently durable and wear-resistant material. The outsole 60 includes bottom which forms a wearing surface of the outsole 60 and may be contoured to define a desired tread pattern. Moreover, the bottom may be textured to improve the traction and aesthetic appeal of the shoe.

III. Manufacture

Figure 6:
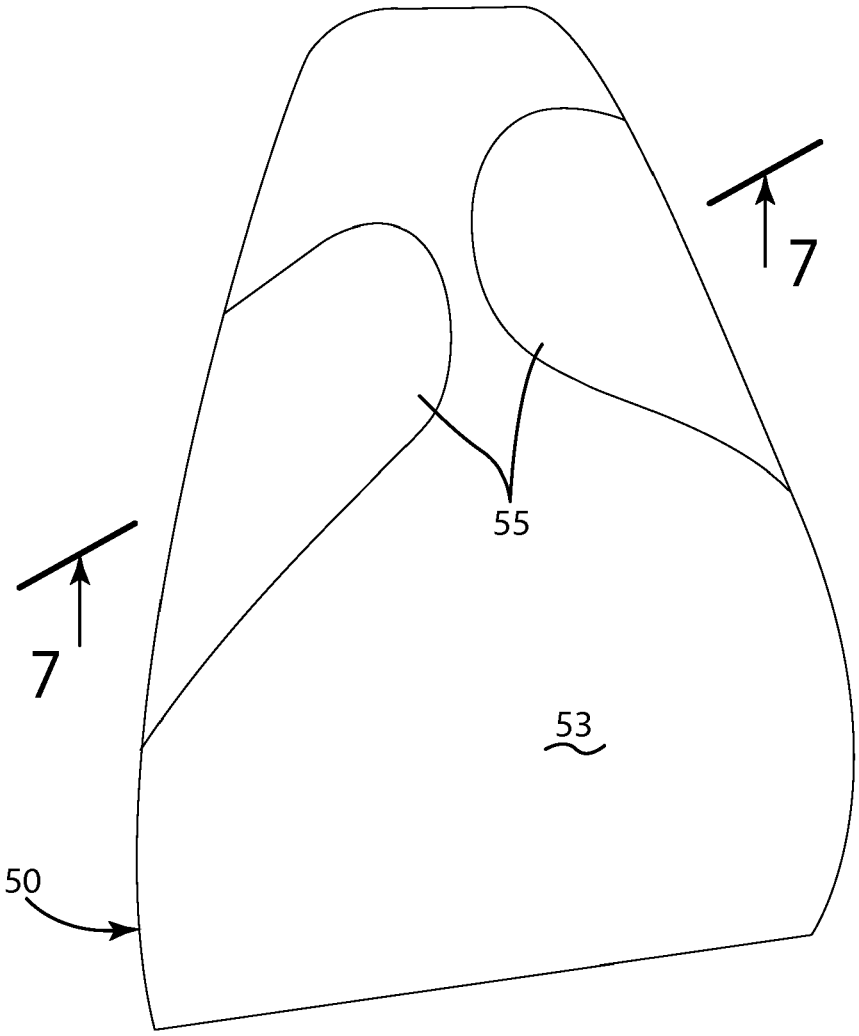
FIG. 6 is a top view of a cushion insert of the footwear.
Figure 7:
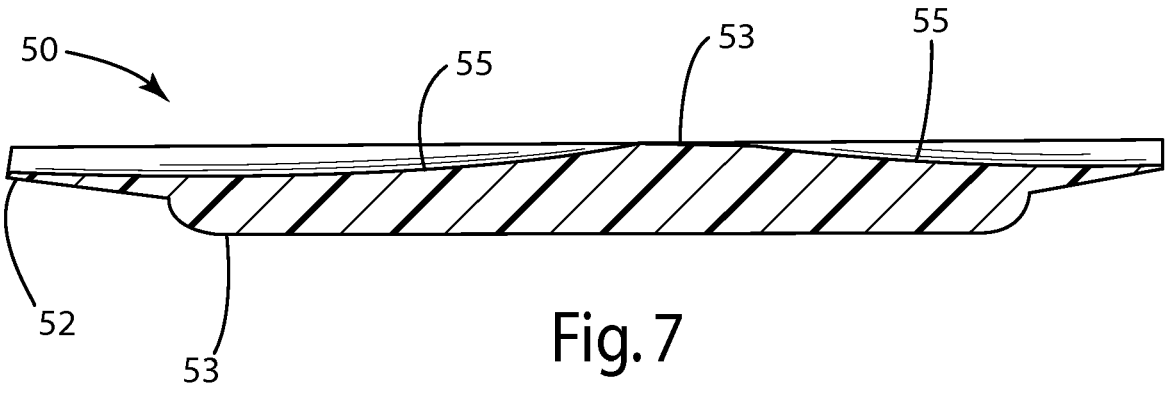
FIG. 7 is a sectional view of the cushion insert taken along line 7-7 of FIG. 6.

Manufacture of the shoe 10 will now be described with reference to FIG. 6. The upper 20 and California flange 30 are manufactured using generally conventional techniques and apparatus. The desired upper material (not shown) is cut to form the upper and its components, which are then fitted and sewn together. The California flange 30 is secured to the peripheral allowance 25 of the upper with adhesives or stitching. The flange can be secured in such a manner that the aesthetic side 33 initially faces the upper and a second side 35 faces outward. A bottom 28 is further secured to the upper 20 as shown.

With the upper 20 constructed, and the California flange 30 and bottom 28 secured to the upper 20, these components are force lasted, that is, they are forced onto the last 100 (force may be required to stretch the upper and the bottom 28 over the last).

The platform 40 also can be assembled. Specifically, the cushion insert 50 can be joined with the platform 40. To do this, the projecting portion 53 can be placed in the aperture 42 defined by the platform so that the base 52 rests on the margin 41 of the platform. Optionally, the base 52 can be adhered or otherwise fastened to the platform 40.

The assembled platform 40 is adhered or cemented to the bottom 28 and any remaining portion of the peripheral allowance 25 rearward of the bottom 28, for example, the allowance 25 in the heel.

With the platform 40 joined to the upper 20, the California flange 30 is wrapped around at least a portion of the periphery 45 of the platform 40 and fastened, for example by gluing, to the underside 44 of the platform. Specifically, a portion of the California flange 30 conceals a portion of the periphery 45 of the platform 40 and the cushion insert 50, and the remaining portion of the flange 30 is glued to the underside of the platform. The platform and the cushioned insert project above the portion of the California flange secured to the underside of the platform a distance.

With the platform 40 wrapped with the California construction, an optional heel post 90 can be joined with the platform, for example, by driving a fastener through the platform and into the heel post.

In addition, an outsole 60 can be secured via cementing or other means to the platform and/or heel. This outsole 60 can be injection molded or pour molded from a hard, durable rubber using conventional molding apparatus. Its construction can be completed before any other components of the footwear are assembled as desired.

With the outsole 60 secured to the other components of the shoe, the shoe 10 can be removed from the last 100. A number of conventional finishing operations may then be performed on the shoe 10. For example, the edges of the outsole 60 can be trimmed and shaped; and the upper 20 and flange 30 can be cleaned, polished and treated as appropriate and necessary. With the components assembled and completed, the shoe 10 can be readied for subsequent processing, packaging and shipping.

The above description is that of various embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A footwear construction comprising:

an upper including a peripheral allowance at a lower portion of the upper, a separate flange joined with the peripheral allowance;

a platform defining a cushion aperture and including an underside, the platform positioned adjacent the upper;

a cushion insert adjacent the platform and projecting at least partially into the cushion aperture; and an outsole joined with at least one of the platform and the upper, wherein the flange extends downwardly from the peripheral allowance and wraps around at least a portion of the underside of the platform, wherein the platform and the cushion insert extend a height above the wrapped portion of the flange and the outsole, whereby when a user's foot is in the footwear construction, the foot is positioned at about the height so that the user's stature is increased by about the height and the foot is simultaneously cushioned by the cushion insert.

2. The footwear construction of claim 1 wherein the platform includes an upper surface defining at least one recess that is aligned with at least one of the user's toes.

3. The footwear construction of claim 2 wherein the platform defines at least two different recesses, one aligned with a user's big toe and another aligned with other toes.

4. The footwear construction of claim 1 wherein at least a portion of the peripheral allowance remains positioned above the underside of the platform.

5. The footwear construction of claim 4 wherein the upper is secured to the platform with a second construction void of the separate flange in the heel region.

6. The footwear construction of claim 1 wherein the platform includes an upper side opposite the underside, wherein the peripheral allowance is positioned above the upper side of the platform.

7. The footwear construction of claim 1 comprising a bottom joined with the upper to close a portion of the upper, the bottom including a lower surface adjacent at least one of the platform and the cushion insert, the bottom including an upper surface opposite the lower surface.

8. The footwear construction of claim 1 wherein a portion of the cushion insert extends into the cushion aperture, and a remaining portion overlays an upper surface of the platform surrounding the cushion aperture.

9. A footwear construction comprising:

an upper defining an interior and including a lower portion that terminates at a peripheral allowance;

a flange positioned adjacent and joined with the peripheral allowance, the flange extending downwardly from the peripheral allowance;

a platform joined with the upper and including an upper surface, a lower surface, a forefoot portion and a heel portion, the platform defining an aperture in the forefoot portion, the flange wrapped around at least a portion of the forefoot portion;

a cushion insert adjacent the platform the cushion insert being disposed at least partially in the aperture, the cushion insert including an upper surface defining at least one concave contour corresponding to the position of at least one toe of a wearer of the footwear construction so that the at least one toe rests at least partially within the concave contour thereby reducing a profile of the at least one toe above the cushion insert; and an outsole adjacent the lower surface of the platform.

10. The footwear construction of claim 9 comprising a heel cushion positioned adjacent the upper surface in the heel portion of the platform.

11. The footwear construction of claim 9 wherein the flange terminates short of the heel portion, and wherein the upper is cemented to the heel portion of the platform.

12. The footwear construction of claim 11 including a high heel attached to the heel portion of the platform.

13. The footwear construction of claim 12 wherein the upper includes a bottom attached to the upper surface of the platform.

14. The footwear construction of claim 9 wherein the platform includes a peripheral edge that conforms to the interior of the upper, wherein the flange is wrapped around at least a portion of the peripheral edge.

15. The footwear construction of claim 9 wherein the flange includes an end portion that is disposed adjacent an underside of the platform.

16. The footwear construction of claim 9 wherein the platform and cushion support a wearer's foot above the outsole at a height, wherein at least one of the platform and insert cushion include an outer periphery, wherein the flange conceals the outer periphery.

17. The footwear construction of claim 16 wherein the flange includes a first portion above the platform and a second portion wrapped below the platform.

18. The footwear construction of claim 17 wherein the peripheral allowance is positioned above the platform.

* * * * *